United States Patent [19]

Yanagita

[11] 4,347,011

[45] Aug. 31, 1982

[54] FOUNTAIN PEN EQUIPPED WITH A RESILIENCY ADJUSTMENT DEVICE

[75] Inventor: Seikichi Yanagita, Chigasaki, Japan

[73] Assignee: Pilot Man-Nen-Hitsu Kabushiki Kaisha, Tokyo, Japan

[21] Appl. No.: 92,878

[22] Filed: Nov. 9, 1979

[30] Foreign Application Priority Data

| | | | |
|---|---|---|---|
| Nov. 17, 1978 | [JP] | Japan | 53-141094 |
| Feb. 28, 1979 | [JP] | Japan | 54-22030 |
| Feb. 28, 1979 | [JP] | Japan | 54-22031 |
| Feb. 28, 1979 | [JP] | Japan | 54-22032 |
| Jul. 16, 1979 | [JP] | Japan | 54-97665[U] |

[51] Int. Cl.[3] ..... B43K 1/02

[52] U.S. Cl. ..... 401/231; 401/249

[58] Field of Search ..... 401/231–236, 401/249, 250, 251

[56] References Cited

U.S. PATENT DOCUMENTS

| | | | |
|---|---|---|---|
| 881,215 | 3/1908 | Hurdemann | 401/231 |
| 1,641,511 | 9/1927 | Swasey | 401/242 |
| 1,661,225 | 3/1928 | Kovals | 401/249 X |
| 1,695,913 | 12/1928 | Burke | 401/249 |
| 1,746,065 | 2/1930 | Van Sant | 401/231 |
| 2,128,456 | 8/1938 | Dusenbury | 401/249 |
| 2,669,970 | 2/1954 | Gordon | 401/231 |

*Primary Examiner*—Edward M. Coven

*Attorney, Agent, or Firm*—Sughrue, Mion, Zinn, Macpeak & Seas

[57] ABSTRACT

A fountain pen in which the resiliency of the pen tip is continuously variable. The pen tip and core are surrounded at their mounting end by a pen core cover. A guide slot is formed in a guide portion of the cover in which is positioned a flexible tongue-shaped retaining member which arches from the slot towards the pen point. A knob extends from the mounting portion of the retaining member into a spiral groove in the inner surface of a rotatable cylindrical adjustment sleeve. Rotation of the sleeve moves the retaining member in and out to thereby adjust the resiliency of the tip.

22 Claims, 54 Drawing Figures

FOUNTAIN PEN EQUIPPED WITH A RESILIENCY ADJUSTMENT DEVICE

BACKGROUND OF THE INVENTION

This invention relates to fountain pens and more particularly to a fountain pen equipped with a device by which the resiliency of the pen can be continuously adjusted.

If a hard resiliency is imparted to a writing pen point, the width of a line written therewith is uniform or is varied only according to the direction of writing. On the other hand, if the pen point has a soft resiliency, the width of a line written therewith is also varied according to variations in writing pressure which occur during writing.

It has long been felt desirable to be able to vary the resiliency of a pen point thereby to change the writing conditions so that one can produce both kinds of handwriting with one fountain pen. As an example of a prior art construction, in German Pat. No. 735131, a cylindrical member is positioned around the nib of a fountain pen with a surface contact portion provided at the end portion of the cylindrical member in such a manner that it is in contact with a portion of the nib. The resiliency of the pen point may be varied by the position of the surface contact portion. In order to provide satisfactory writing properties, the pen body has a curved configuration which varies over the entire pen from base to the top. That is, the pen body is not of uniform curvature. Therefore, if the resiliency of the pen is changed by moving the cylindrical member while the latter is depressed directly against the nib, the configuration of the pen is greatly changed. In this case, far from producing a usable resiliency variation, one cannot write with the pen. Accordingly, it is impossible to provide satisfactory fountain pens according to this patent document. In fact, so far as is known, such fountain pens have never been manufactured.

In a fountain pen disclosed by German Pat. No. 819054, a retaining metal member is brought into surface contact with the pen nib to change the resiliency of the pen. For the same reason as described above, such a pen has fatal detects which render it unfit for practical use.

In German Pat. No. 737672, a retaining metal member is placed in surface contact with the pen and writing pressure is exerted on the pen by manual pressure on the retaining metal member without moving the position of the retaining metal member in order to vary the handwriting. According to this technique, if the pen point itself is deformed by pressure, then one cannot satisfactorily write with the pen. In order to provide satisfactory writing conditions, the configuration of the pen body must have a predetermined curved configuration and the pen be readily deformable because of the material used for the body. Accordingly, only a low pressure may be applied to the pen to the extent that the pen is not deformed thereby. However, with such a low pressure, the handwriting can be only little varied. It is impossible to produce a practical fountain using this technique and, as before, such fountain pens have never been manufactured and used commercially.

U.S. Pat. No. 881,215 discloses a fountain pen in which a retaining metal member is held in contact with the pen nib with the nib held tightly against the core. The text of the patent states nothing about varying the resiliency of the pen. The fountain pen disclosed by this patent is further disadvantageous in that, as the retaining metal member is moved, the ink would be expected to seep into the holder cylinder and the retaining metal member is laterally displacable because no guide for the retaining metal member is provided. Furthermore, the fountain pen is disadvantageous in that, since the pen nib is in surface contact with the portion other than the end portion of the retaining metal member, the retaining metal member cannot be moved when the ink between the pen and the portion of the retaining metal member is dried. Thus, such a fountain pen is not operationally practical.

Japanese Utility Model Application Publication No. 30484/1926 discloses a fountain pen in which a retaining metal member inserted into a tunnel-shaped guide formed in the pen body is placed on the upper surface of the nib and the retaining metal member is moved back and forth in association with the rotation of a rotary ring which is provided on the end portion of the holder cylinder. However, the fountain pen suffers from drawbacks in that the rotational direction of the rotary ring is different from the direction of movement (back and forth) of the retaining metal member, the force in the direction of rotation transmitted from the rotary ring is transferred through the guide to the pen so as to deform the pen, the resiliency of the pen is adversely affected by the presence of the guide, and it is difficult to manufacture the guide.

U.S. Pat. No. 2,669,970 discloses a pen construction in which the handwriting is varied by changing the nib's slit gap. However, the patent contains no teaching of a technique in which writing conditions are varied by changing the resiliency of the pen thereby to vary writing conditions. In the fountain pen of this patent, the pen and the valve are fixed so that they cannot slide and are engaged with the downwardly directed cam of the hood with the opening between the nib halves of the pen controlled by moving the shoulder of the pen back and forth with the cam. The valve does not affect the pen tip and the pen and the valve are fixed so that the pressure applied to the pen tip cannot be varied by moving the valve. In addition, the movement of the pen through the downwardly directed cam of the hood is through a very short distance, and therefore, although such movement may be effective, it may be able to control the opening of the pen but it cannot vary the elasticity of the pen. Thus, the fountain pen disclosed by the patent relates only to the control of the opening of the nib slit of the pen and with no capability of controlling the resiliency of the pen.

German Patent No. 727971, Austrian Pat. No. 42,731 and British Pat. No. 8277-02 disclose techniques for varying the resiliency of a pen tip by depressing the nibs although they do not relate to fountain pens. More specifically, in these patents, the rear portion of the retaining metal member is made cylindrical and the cylindrical portion is slidably inserted into the pen holder. These pens are disadvantageous in the following points. As a guide for guiding the retaining metal member is not provided, the retaining metal member is liable to move sideward. In addition, in a fountain pen of this construction, the cylindrical portion of the retaining metal member is positioned on the outer surface of the holder cylinder and therefore a cap covering the pen cannot be placed over the holder cylinder. Thus, these pens are not practical and could not be used as fountain pens.

Accordingly, an object of this invention is to provide a fountain pen in which all of the above-described difficulties accompanying conventional fountain pens have been eliminated.

A slit for introducing ink to the pen point is essential for a fountain pen. The writing conditions of the fountain pen are substantially determined by the resiliency of the pen tip in the region from the closed end of the slit to the pen writing point. Other essential factors affecting the resiliency are the structure of the pen body and the metal material of the pen and the length of the pen tip.

The resiliency of the tip is an important factor. The pen tip is divided by the slit into two parts as described above. The resiliency of the two nib halves and the spreading resistance between the two parts are also essential factors. If certain types of external forces are exerted on the pen, the nature of the pen may be adversely affected. Especially, torsional stress tends to fatally damage the pen and is to be avoided. Furthermore, a pen tends to be adversely affected by downwardly depressing the entire upper surface of the pen tip because in general this tends to cause the right and left parts of the pen head to become overlapped or to become staggered up and down.

A "closing action" of a pen tip is also desirable. A steel pen for clerical work may not only be worn out but also the point may open after only two or three days use because it has no "closing action" to hold the point together. The "closing action" is essential if a pen is to be used for several tens of years. The cross section of the pen tip is gently curved to provide such a "closing action" to the pen. If the entire upper surface of the pen is depressed, then such curves are eliminated and the "closing action" is defeated. If the entire upper surface of the pen is further depressed, then the ink will flow from the slit to the upper surface of the pen. If different forces are applied to the right and left parts of the pen tip, then the points of the right and left parts may become staggered and, at worst, the pen can no longer be used for writing.

SUMMARY OF THE INVENTION

The inventors have discovered that, in order to vary the writing conditions and handwriting of a fountain pen, it is necessary to depress the pen tip by some means. That is, the writing conditions and handwriting cannot be continuously varied without variably applying a depression force to the upper surface of the pen although this method may involve various drawbacks. In order to eliminate such drawbacks, the inventors have discovered that the pen tip should not be provided with auxiliary, additional components and should not be deformable, the entire surface of the pen should not be depressed, and the pen should be free from torsional and unbalanced forces.

Provided in accordance with the invention is a fountain pen which includes: (a) a pen core cover into which a pen core with a pen tip is inserted and which sealingly covers at least a pen tip mounting portion and an overflow ink containing chamber of the pen core; (b) a guide having a guide slot at one end portion close to the pen tip of the pen core cover in such a manner that the guide slott is on the axial line of the upper surface of the pen; (c) a tongue-shaped flexible retaining metal (or plastic) member having a knob and a first end portion contacting the pen tip and including a curved portion which is curved towards the pen tip to form an air gap between the curved portion and a second portion other than the first end portion, a straight portion which is not in contact with the pen tip, the retaining metal member being inserted into the guide hole so as to be slidable on the outer surface of the pen core cover and to be slidable with respect to the pen tip; (d) a rotation-type shifting cylinder which is rotatably mounted on the pen core cover permitting a shifting groove to engage with the moving knob of the retaining metal member, the shifting groove being formed in the inner surface of the rotation-type shifting cylinder; and (e) a holder cylinder which is detachably mounted on the pen core cover.

A fountain pen according to the invention further includes a cylindrical ink leakage preventing packing which is disposed in the air gap between the rotation-type shifting cylinder and the pen core cover in such a manner that the packing is in contact with both of the inner surfaces of the rotation-type shifting cylinder and the pen core cover.

A fountain pen according to the invention yet further includes a cylindrical ink blocking packing which is disposed in the air gap between the pen core cover and the holder cylinder in such a manner that the packing is in contact with both the pen core cover and the holder cylinder.

With a pen of the invention, at least the pen tip mounting portion and the over-flow ink containing chamber in the form of, for instance, comb-shaped grooves are sealed by the pen core cover. The purpose of this construction is to supply the ink introduced to the pen core only to the pen tip and to prevent the ink from seeping to the pen holder cylinder. The guide is provided in the end portion closer to the pen tip of the pen core cover. In this connection it is essential that the guide hole be positioned as close to the pen as possible in order to prevent sideward displacement of the retaining metal member being guided. The sideward displacement of the retaining metal member would cause an unbalanced force to be applied to the pen. The guide slot may be not only the groove but also the tunnel-shaped hole. However, should it be desired to provide a pen which is capable of withstanding strong depression forces, it is most effective to employ a tunnel-shaped guide hole. The number of guide holes may be one or more. However, it is essential to provide the guide holes in the pen core cover instead of the pen tip. The guide forming the guide hole or guide holes may be formed by protrusions or various configurations. However, it is preferable that the protrusion be the flange which serves as the stopper for the rotation type shifting cylinder. In addition, the guide may have a tunnel-shaped guide hole having a protrusion forming a groove-shaped guide hole and a nut engaged with the outer surface of the protrusion. This guide forming technique is suitable for a case in which, as described below, the holder cylinder and the pen core cover are formed as a single unit. Furthermore, the guide may be constituted by the guide slot and a groove formed as a prolongation of the guide hole or may be such that a cylindrical member with a slot which is engaged with the knob of a retaining metal member is coupled to the pen core cover having the guide hole in such a manner that the slot is coincident with the prolongation of the guide hole.

In the case of a guide using the cylindrical member, one end portion of the cylindrical member is extended to cover the groove-shaped guide slot so that the guide slot is tunnel-shaped.

The tongue-shaped retaining metal member has a first end portion which is brought into contact with the pen. That is, it includes a curved portion which is curved towards the pen tip to form an air gap between the pen tip and a portion other than the first end portion and a straight portion which is not brought into contact with the pen tip. In other words, the type of entire surface contact which adversely affects the pen is prevented, the resiliency of the retaining metal member with respect to the pen is controlled by curving the retaining metal member, and leakage of ink is prevented by forming the air gap between the retaining metal member and the pen. More specifically, as the retaining metal member has a continuous configuration, accordingly, no stress is concentrated on the retaining metal member and therefore the latter can withstand loads repetitively applied thereto. As such, the durability of the retaining metal member is increased and the force holding the pen tip is maintained unchanged over long periods of time.

Furthermore, since only the end portion of the curved retaining metal member is brought into contact with the pen, that is, the retaining metal member is in point or line contact with the pen tip, a portion of the pen tip which extends from the contact position to the writing point can be deflected when writing pressure is applied to the pen tip. Accordingly, the pen tip is made extremely hard by using the flexible retaining metal member. On the other hand, if writing pressure were to be applied to the pen in the surface contact state, the force of the retaining metal member applied to the pen would be dispersed making it impossible to make the pen tip sufficiently hard. Thus, it is necessary that the retaining metal member be rigid. However, a rigid retaining metal member is disadvantageous in that the pen tip cannot be deformed and the retaining metal member cannot be moved. An end portion, opposite to the end portion in contact with the pen of the retaining metal member is formed into a straight portion with no longitudinal curving. Therefore the retaining metal member can be satisfactorily coupled to the pen core cover and can be smoothly moved back and forth.

The above-described retaining metal member is slidably arranged on the outer surface of the pen core cover by inserting it into the guide hole so that it is slidable with respect to the pen. In this case, a step is formed between the upper surface of the pen and the sliding surface of the retaining metal member by the thickness of the pen core cover. Thus, movement of ink towards the holder cylinder is prevented even if the retaining metal member is moved. The end portion, opposite to the first end portion, of the retaining metal member may be formed as an annular (circular or arcuate) portion which is slidably coupled to the pen core cover. It is suitable that the end portion in contact with the pen tip of the retaining metal member be at least in contact with pen tip nib portions on both sides of the slit of the pen tip because, with this construction, the pen nib halves are balanced as to the amount of their deflection and the pen point can smoothly slide on the sheet.

Furthermore, it is most suitable for the retaining effect of the retaining metal member that the whole or part of the retaining metal member be formed with an arcuate or angular cross-section. The material of the retaining metal member may be metal such as phosphorous bronze or stainless steel or plastic. The surface of the retaining metal member may be plated to increase its ink resistance.

For the guide including the cylindrical member, it is preferable that the cylindrical member have a pen core cover coupling portion and a holder cylinder coupling portion which are coupled respectively to the coupling portions of the pen core cover and the holder cylinder. In this case, the rotation of the pen core cover which may be caused by the rotation of the rotation-type shifting cylinder can be positively prevented. More specifically, as the fountain pen is constructed as described above, when the portion closer to the pen of the holder cylinder is held with one hand while the rotation-type shifting cylinder is turned with the other hand, rotation of the rotation-type shifting cylinder is transmitted to the pen core cover but rotation of the pen core cover can be effective prevented because the pen core cover is coupled through the cylindrical member to the holder cylinder.

The pen core cover coupling portion of the cylindrical member may be a hole or a protrusion which is formed on the end portion closer to the pen tip of the cylindrical member and is fixedly engaged with a corresponding protrusion or hole formed in the pen core cover.

The holder cylinder coupling portion of the cylindrical member may also be a hole or a protrusion which is formed on the end portion remote from the pen tip of the cylindrical member and is fixedly engaged with a corresponding protrusion or hole formed in the holder cylinder. In addition, the open end portion of the slot of the holder cylinder may be utilized for the same purpose. Alternatively, the two coupling portions may be formed into grooves.

It is most suitable for preventing sideward displacement of the retaining metal member that the end portion, opposite to the first end portion, of the retaining metal member protrude upwardly so as to be slidably engaged with the slot of the holder cylinder because in this case the retaining metal member is supported by the guide of the pen core cover and the guide hole of the cylindrical member. The protruded portion may be provided by bending or expanding a part of the retaining metal member or by affixing a small piece to the retaining metal member.

The diameter of a fountain pen is limited because it is used with a hand and the size of the pen core cannot be reduced as a practical matter because it must hold a pen tip and supply ink to the pen. Therefore, it is essential that the pen core cover be a very thin cylinder. If such a pen core is made of plastic and has a groove for forming the guide, its portion near the groove, which is very thin, may be deformed during use or assembly of the fountain pen with the result that the pen core cover may be cracked as a result of which the pen core cover can no longer adequately cover the over-flow ink containing chamber. Therefore, it is preferable that an air gap be provided between the upper surface of the mounting portion of the pen tip and the pen core cover to prevent the pen tip from depressing the portion near the groove of the pen core cover.

It is suitable that the air gap be less than 0.2 mm, preferably less than 0.15 mm. If the gap is outside this range, the capillary attraction of holding ink in the air gap is reduced and the ink supplied through the pen core ink groove may splash out even by a slight impact.

The knob of the retaining metal member is engaged with the shifting groove in the rotation-type shifting cylinder which is in turn rotatably coupled to the pen core cover. The retaining metal member is moved back and forth by rotating the rotation-type shifting cylinder while the guide provided on the end portion of the pen core cover serves as the stopper for the holder cylinder and the rotation-type shifting cylinder. The writing conditions of the pen are such that when the point near the writing end of the pen is depressed, the pen is hard and the width of the written line thin. The shifting groove formed in the inner wall of the rotation type shifting cylinder is preferably a spiral goove so that the retaining metal member can be finely positioned. Alternatively, it may be a cam groove. In the invention, the pen core cover may be coupled directly to the holder cylinder or it may be coupled to the holder cylinder through the coupling cylinder. The rotation-type shifting cylinder may be positioned before the holder cylinder or the front holder cylinder with respect to the pen, or vice versa.

A novel ink leakage preventing mechanism which is not known in the art and is one of the specific features of the present invention will next be described.

A cylindrical ink leakage preventing packing is inserted into the gap between the rotation-type shifting cylinder and the pen core cover in such a manner that it is in close contact with the rotation-type shifting cylinder and the holder cylinder. The purpose of this packing is to eliminate the drawback that when ink is supplied to the pen by dipping the tip end into an ink bottle, the ink is introduced towards the holder cylinder and the ink leaks from between the rotation-type shifting cylinder and the hold cylinder.

In this case, the packing may be brought into contact with the rotation-type shifting cylinder, the holder cylinder, and the pen core cover. Furthermore, one end portion of such a packing may extend into the holder cylinder so as to be in contact with the inner wall of the holder cylinder. In this arrangement, the ink is sealed by the packing and the holder cylinder whereby ink leakage is positively prevented.

One end portion of a cylindrical packing, which is cut at the middle portion into two parts which overlap one another, may extend into the holder cylinder in such a manner as to be in contact with the inner wall of the holder cylinder. It is desirable that the pen core cover be fixed to the holder cylinder. This may be achieved in a known manner. However, if the pen core cover is fixed by using one end portion of the aforementioned packing which protrudes into the holder cylinder so that a sealing effect is also provided, then it is unnecessary to use an additional fixing means. That is, the pen core cover can be readily fixed. If the packing is cut at the middle portion into two parts which overlap and sealing is effected by the overlapped surfaces of the two parts, then the rotational friction is only the frictional resistance of the overlapped surfaces whereby the rotation can be made smooth.

The cylindrical ink leakage preventing packing may be arranged in such a manner that it is not in contact with the pen core cover but in contact with the holder cylinder and the rotation-type shifting cylinder. In this arrangement, leakage of ink can also be effectively prevented and the retaining metal member can be moved smoothly. That is, since it is unnecessary to bring the packing into contact with the rotation-type shifting cylinder and the pen core cover, the frictional resistance is reduced to provide smooth rotation.

In addition, in accordance with the invention, a cylindrical ink blocking packging is inserted into the gap between the pen core cover and the holder cylinder in such a manner as to be in contact with both. Application of this packing is quite effective in that it can completely seal the entered ink.

The former packing may be fixed in any suitable manner. However, it is most suitable to fix the packing by setting it in a recess formed in the rotation-type shifting cylinder, the pen core or the holder cylinder, or in recesses formed in both of the rotation-type shifting cylinder and the holder cylinder.

The latter packing may be fixed in any suitable manner also, or it may be fixed by setting it in a recess formed in the pen core cover or the holder cylinder or in recesses formed in both of the pen core cover and the holder cylinder. However, the following technique is most suitable for fixing the packing. The pen core cover is screwed into the holder cylinder or the coupling cylinder, and the packing is tightened therebetween. The threaded stopper is screwed over the pen core cover and the packing is tightened therebetween so as to be fixed. That is, by finely adjusting the position of the threaded stopper, the rotation-type shifting cylinder positioned between the guide of the pen core cover and the holder cylinder can be freely tightened or released to adjust the rotational condition of the rotation-type shifting cylinder.

In the invention, the ring-shaped packing is included in the cylindrical packing, and these packings may be made of rubber such as NBR or silicon rubber, or plastic such as ABS resin, polyethylene, urethane resin or fluororesin. The above-described ink leakage preventing packing may be employed as a stopper which is used when the retaining metal member is moved backward.

DESCRIPTION OF THE PREFERRED EMBODIMENT

Figure 1:
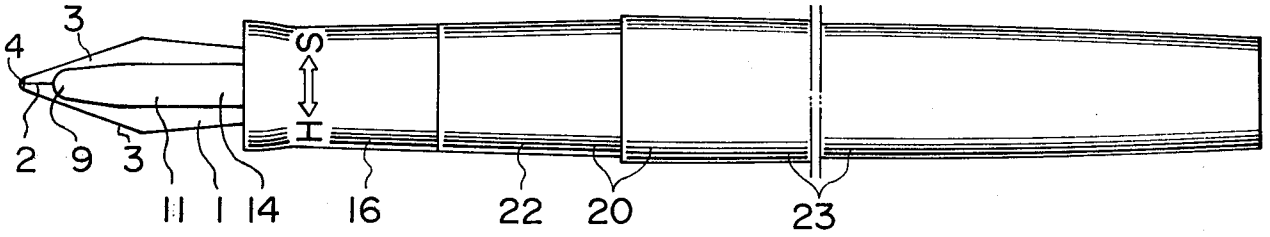
FIG. 1 is an enlarged plan view of a fountain pen according to the invention, with its middle portion omitted.

This invention will be described with reference to the accompanying drawings.

In FIGS. 1 through 4, a pen tip 1, gently curved in section, has pen nib halves 3 which are separated from each other by a slit 2. The nib halves 3 are resilient. The pen 1 further has a wear-resisting pen point 4 at the top of the slit.

The pen tip 1 is mounted upon a pen core 5. The pen core 5 extends longitudinally, and has a capillary pen core groove (not shown) communicating with the slit 2, and an over-flow ink containing chamber (not shown) for receiving over-flow ink, the quantity of which is more than required for maintaining a normal writing speed. The over-flow ink containing chamber is in general formed as comb-shaped grooves.

The pen core 5 is inserted into a cylindrical pen core cover 6. The cover 6 sealingly covers the mounting portion of the pen tip 1 and the over-flow ink containing chamber of the pen core 5 and has a flange-shaped guide 7 at its end closer to the pen tip, that is, disposed towards the writing point at the end of the tip. Provided in the guide 7 is a groove-shaped guide slot 8 which is on the axial line of the upper surface of the pen 1. The guide slot 8 guides a flexible retaining metal member 11 having an end portion 9 which is brought into contact with the pen and a knob 10. The pen core cover 6 has a threaded portion 12 on the outer wall of the middle portion thereof. A groove 13 is formed longitudinally in the threaded portion 12 in such a manner that one end thereof is open but its other end, closer to the pen tip is closed.

The retaining metal member 11 has a curved portion which curves toward the pen tip thereby to form an air gap between the pen tip 1 and its portion other than the end portion 9 and which has at its side opposite to the end portion 9 brought into contact with the pen tip 1 a straight portion 14 which is not curved longitudinally and is in contact with the pen tip 1. The other end portion of the retaining metal member 11 opposite to the end portion 9 is formed into a ring-shaped annular portion 15. The annular portion 15 is placed over and around the pen core cover 6 in such a manner that the retaining metal member 11 is slidable on the outer surface of the pen core cover 6.

The knob 10 is engaged with a shifting groove 17 which is formed in the inner wall of a rotation-type shifting cylinder 16 which is rotatably inserted over the pen core cover 6 in such a manner that its end portion closer to the pen tip is in engagement with the guide 7. An annular recess 18 is formed in the inner wall of one end portion of the shifting cylinder 16 opposite to the side of the pen tip of the cylinder 16. Disposed in the recess 18 is a ring-shaped ink leakage preventing packing 19 which is brought in contact with both of the cylinder 16 and the pen core cover 6. The arrows on the surface of the cylinder 16 indicate "forward" and "backward" and the characters "H" and "S" indicate "Hard" and "Soft", respectively.

Connected to the rotation-type feeding cylinder 16 is a holder cylinder 20 into which the pen core cover is detachably inserted. The holder cylinder 20 includes a front holder cylinder 22 and a rear holder cylinder 23 coupled thereto through a coupling cylinder 21. The front holder cylinder 22 has a protrusion 24 which extends inwardly from the inner wall thereof. The protrusion 24 engages a groove of the pen core cover 6. One end portion of the coupling cylinder 21 which is inserted into one end opening of the front holder cylinder 22 has a threaded portion 25 on the inner wall. The threaded portion 25 is engaged with a threaded portion 12 of the pen core cover 6 behind the protrusion 24. The other end portion of the coupling cylinder 21 is screwed into the rear holder cylinder 23. In the figures, reference numeral 26 designates a flange formed on the coupling 21.

An ink cartridge 27 accomodated in the rear holder cylinder 23 coupled to the rear portion of the pen core cover 6 supplies ink to the above-described capillary pen core groove (not shown).

The resiliency of the pen 1 can be made hard by holding the front holder cylinder 22 with one hand and by turning the rotation-type feeding cylinder 16 in the direction of "H" with the other hand. As the knob 10 engages with the shifting groove 17 formed in the inner wall of the cylinder 16, the retaining metal member 11 is moved forward with the annular portion 15 engaged with the pen core cover 6. The forward movement of the retaining metal member 11 is smoothly carried out because the member 11 includes the straight portion 14 which has no curve in the longitudinal direction. The sideward displacement thereof can be prevented because the guide hole 8 is sufficiently near the pen tip 1. If, when the end portion 9 of the retaining metal member 11 is moved to a suitable position on the slit 2, the rotation of the shifting cylinder 16 is stopped and the end portion 9 presses against the upper surface of the nib halves in that position. Thus, adjustment of the resiliency of the pen tip 1 is achieved.

The retaining metal member 11 is curved towards the pen tip and only the end portion 9 is in point or line contact with the pen nib 3 on both sides of the slit 2 of the pen tip 1. Therefore, upon application of a writing pressure, the writing point of the pen tip 1 is deflected more than the contact point, as a result of which the amount of deflection of the pen nib halves 3 are uniform and the handwriting is characterized as hard. The air gap is provided between the pen tip 1 and the portion other than the end portion 9 of the retaining metal member 11 and a step is formed between the upper surface of the pen tip 1 and the sliding surface of the retaining metal member of the pen core cover 6 because of the thickness of the pen core cover 6. Accordingly, flow of ink from the slit 2 to the upper surface of the pen tip 1 and into the rotation type shifting cylinder 16 can be prevented.

If it is required to set the pen tip 1 for soft writing characteristics, the rotation-type shifting cylinder 16 is rotated in the direction of the mark "S" to move the retaining metal member 11 backward. In this case, the pen tip 1 produces soft writing characteristics with the backward movement of the retaining metal member 11 so that the width of the line written with the pen may be varied in accordance with the force which is applied to the pen during writing.

Figure 5:
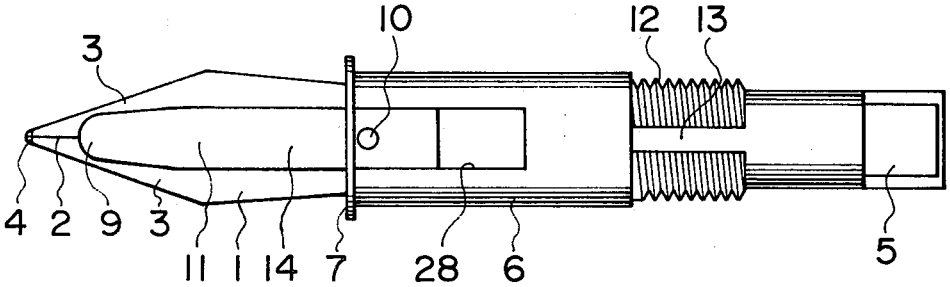
FIG. 5 is a plan view showing a first modification of the connecting technique of the pen core cover and the retaining metal member.
Figure 6:
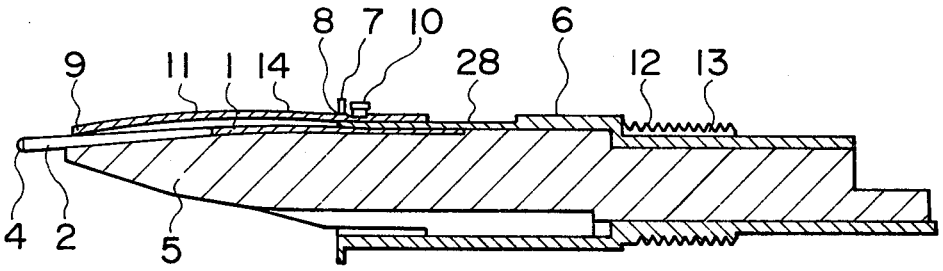
FIG. 6 is a cross-sectional view of a part of the fountain pen shown in FIG. 5.
Figure 7:
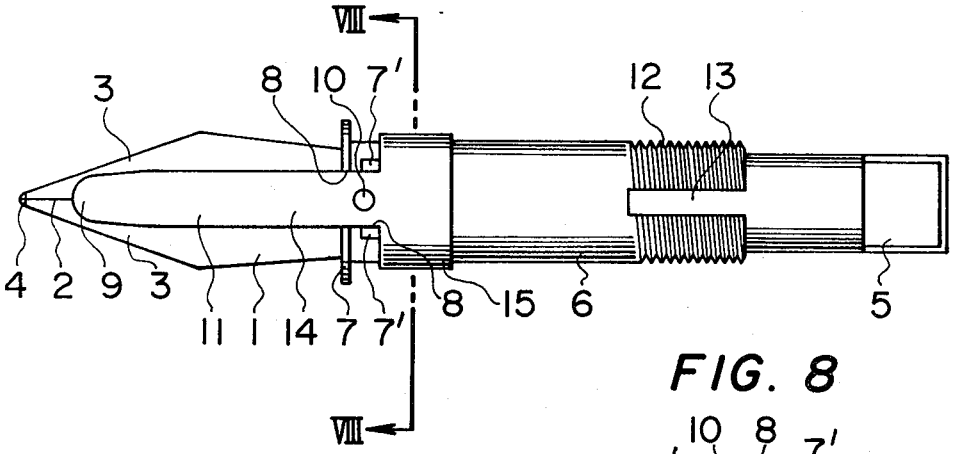
FIG. 7 is a plan view showing a second modification of the connecting technique of the pen core cover and the retaining metal member.
Figure 8:
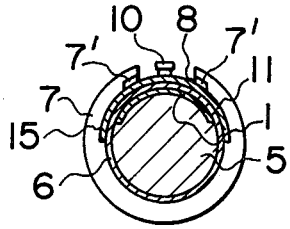
FIG. 8 is a sectional view taken along line VIII—VIII in FIG. 7.

The guide 7 may be constructed as a tunnel-shaped guide slot 8 with a groove 28 provided on the extension line of the guide slot 8 so that the retaining metal member 11 is slidable along the groove 28 and is coupled to the pen core cover 6 as shown in FIGS. 5 and 6. Furthermore, as shown in FIGS. 7 and 8, the pen may be modified in such a manner that a pair of guides 7', which form the groove-shaped guide slot 8 of the guide section of the pen core cover 6 by protruding above the pen core cover 6, are arranged on both sides of the retaining metal member 11 and behind the groove-shaped guide slot 8. The end portion opposite to the end portion 9 of the retaining metal member 11 is formed as an arcuate, annular portion 15 which is slidably mounted on the pen core cover. In both of the above-described cases, the knob 10 provided on the retaining metal member 11 is engaged with the shifting groove 17 formed in the rotation-type shifting cylinder 16.

Figure 9:
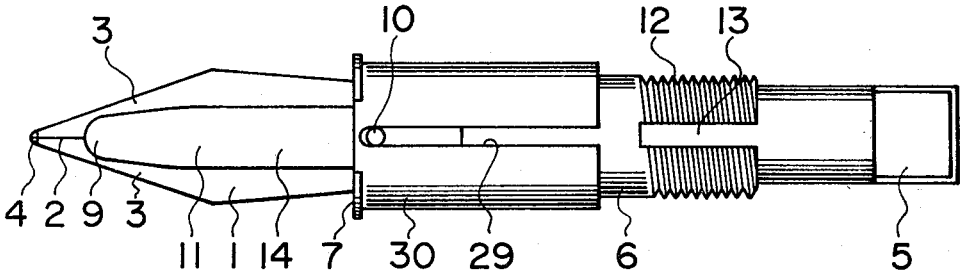
FIG. 9 is a plan view showing a third modification of the connecting technique of the pen core cover and the retaining metal member.
Figure 10:
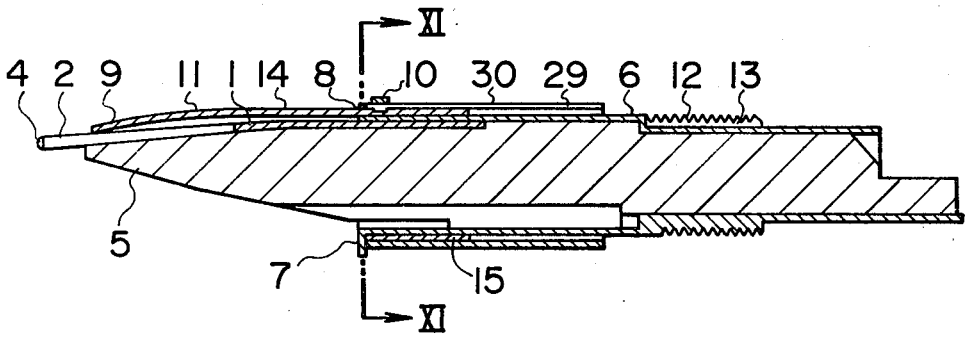
FIG. 10 is a longitudinal cross-sectional view of a part of the fountain pen shown in FIG. 9.
Figure 11:
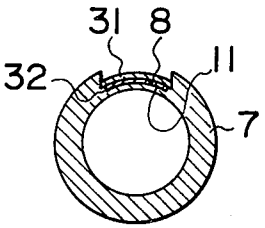
FIG. 11 is a cross-sectional view taken along line XI—XI in FIG. 10.

Furthermore, the pen may be modified as follows. As shown in FIGS. 9 through 11, the guide 7 is so modified that a cylindrical member 30, having a slot 29 which is open at its one end and is engaged with the moving knob 10 of the retaining metal member 11, is positioned around the pen core cover 6 with the closed end of the slot 29 closer to the pen tip and with the direction of the slot being coincident with the extension of the guide slot 8. The slot 29 of the cylindrical member 30 is engaged with the knob 10 of the retaining metal member 11 and the retaining metal member 11 is slidably coupled to the pen core cover 6. In this case also the knob 10 provided on the retaining metal member is engaged with the shifting groove 17 of the rotation-type shifting cylinder 16. Also in this case, the remaining metal member 11 is inserted into a tunnel-shaped guide slot 8 which is formed by placing one protruded end portion of the cylindrical member 30 on the steps which are formed on the groove-shaped guide hole forming edges of the guide 7.

In the above-described embodiment, a ring-shaped packing 19 in contact with both of the rotation-type shifting cylinder 16 and the pen core cover 6 is provided for the recess 18 of the rotation-type shifting cylinder 16. However, since the pen core cover 6 is fixed by inserting the protrusion 24 of the holder cylinder 22 into the groove 13 of the pen core cover 6, the pen core cover 6 is not moved even when the rotation-type shifting cylinder 16 is turned.

Figure 12:
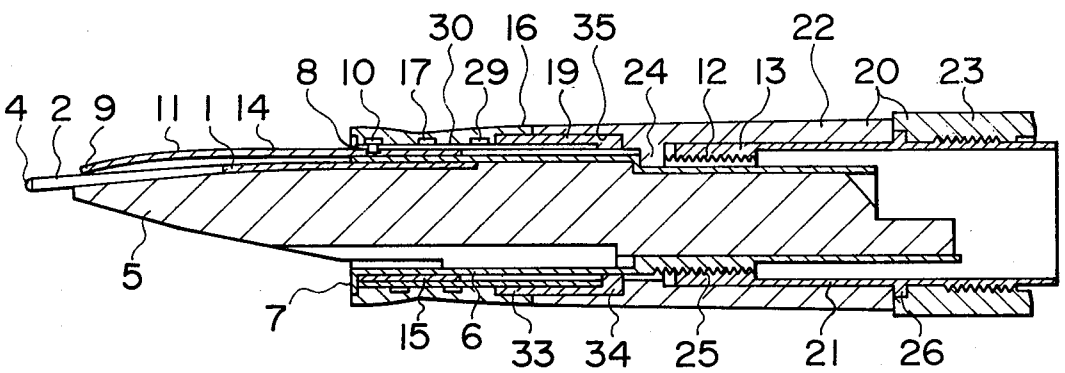
FIG. 12 is a longitudinal cross-sectional view showing the essential components of a fountain pen using a first modification of a packing according to the invention.

In the case where it is required to grip the front holder cylinder 22, a shorter rotation-type shifting cylinder 16 is employed. In this case, it is preferable to employ a longer cylindrical packing 19. An example of such pen resiliency adjusting device as described with reference to FIGS. 10 and 11 is shown in FIG. 12. In this example, the packing 19 is held between the pen core cover 6 and the rotation-type metal member 16 and one end portion of the packing 19 is extended into the front holder cylinder 22 to contact the inner wall of the front holder cylinder 22. More specifically, one end portion of the packing 19, which is closer to the pen tip and is placed over the cylindrical member 30, is formed as a thin annular portion 33 while the opposite end portion is formed as a thick, annular portion 34. The thick portion 34 is in contact with an annular recess 35 which is formed in one end opening of the front holder cylinder 22, the portion 34 being engaged with the pen core cover 6. In this case, as the straight portion 14 of the retaining metal member 11 can be smoothly moved back towards the front holder cylinder 22, leakage of ink is prevented.

Figure 15:
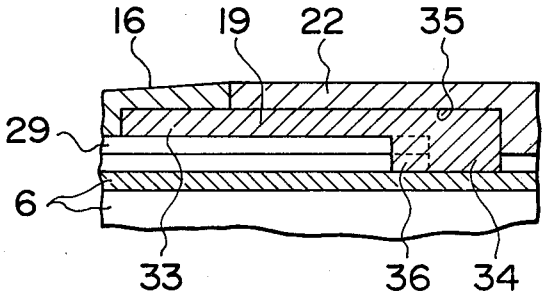
FIG. 15 is an enlarged cross-sectional view showing a part of a fountain pen provided with the packing shown in FIG. 13.
Figure 14:
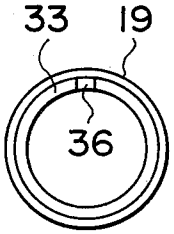
FIG. 14 is a left side view of the packing shown in FIG. 13.
Figure 13:
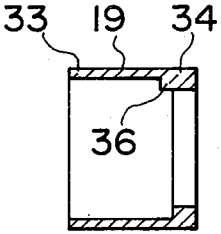
FIG. 13 is a longitudinal cross-sectional view of a second modification of the packing.

In addition, if, as shown in FIGS. 13 through 15, a small protrusion 36 is provided inside the cylindrical packing 19 in such a manner that it protrudes from the thick portion 34 towards the opening end of the thin portion 34 and the small protrusion 36 is inserted into the rear portion of the slot 29 of the cylindrical member 30, then diametrical deformation of the cylindrical member 30 is prevented. The protrusion serves as a stop when the retaining metal member 11 is moved backward.

Figure 2:
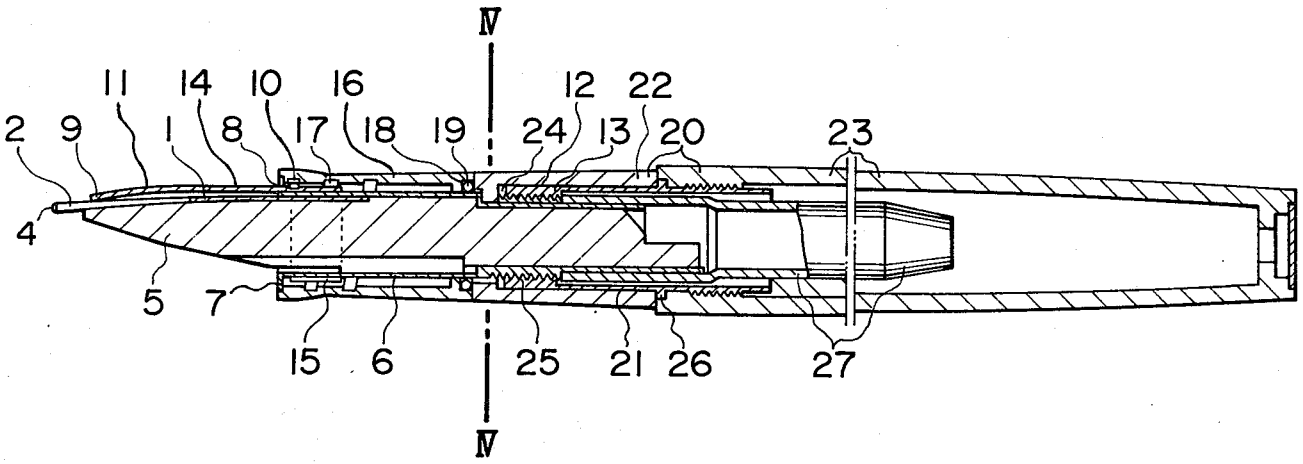
FIG. 2 is a longitudinal cross-sectional view of the fountain pen in FIG. 1.
Figure 3:
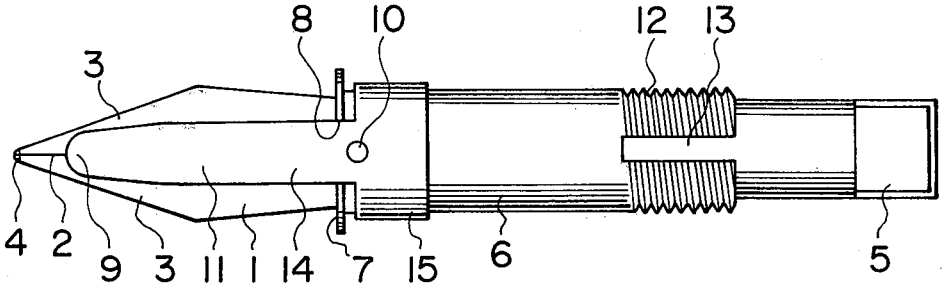
FIG. 3 is a plan view showing a pen core cover coupled to a retaining metal member in the fountain pen in FIG. 2.
Figure 4:
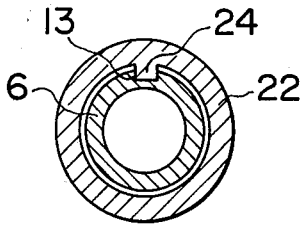
FIG. 4 is a cross-sectional view taken along line IV—IV in FIG. 2 with the central component not shown.
Figure 16:
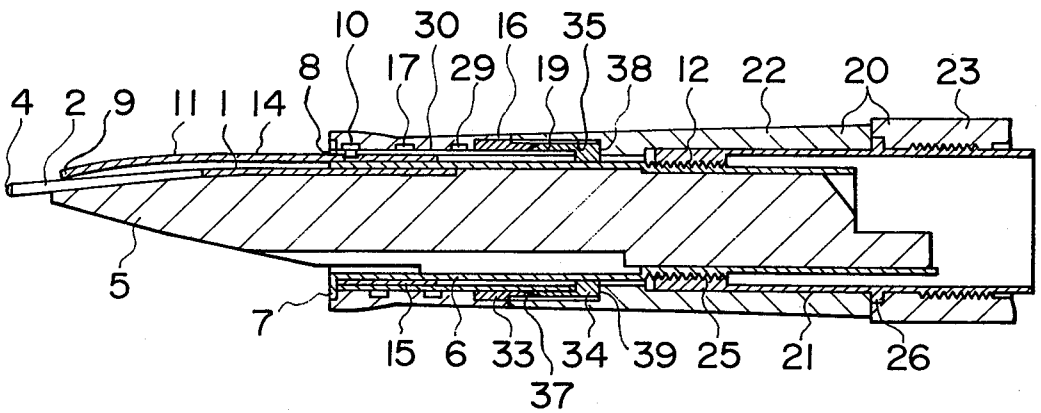
FIG. 16 is a longitudinal cross-sectional view of the essential components of a fountain pen, showing a third modification of the packing.

A packing 19, as shown in FIG. 16, is held between the pen core cover 6 and the rotation metal member 16 with its thick portion 34 protruding into the front holder cylinder 22 to contact the inner wall of the front holder cylinder 22. Furthermore, the packing 19 is cut at the middle portion into two parts which overlap one another. If this packing 19 were to be used to seal the ink with the overlapped surface 37 of the two parts, frictional resistance of the overlapped surfaces 37 is produced as a result of which the pen core cover 6 does not follow the rotation of the rotation-type shifting cylinder 16 and can therefore be fixed to the front holder cylinder 22. Thus, in this example, it is unnecessary to provide the protrusion 24 of the front holder cylinder as shown in FIGS. 2 through 4 and the groove 13 of the pen core cover 6 into which the protrusion 24 is inserted. It is preferable that the inner wall of the front holder 22 and the thick portion 34 of the packing 19 in contact with this inner wall form the surface of a step formed at the recess 35 in the front holder cylinder 22. The end face 39, remoter from the pen tip, of the thick portion 34 is in contact with the step surface 38. Only the upper surface, closer to the pen tip, of the thin portion 33 is engaged with the rotation-type shifting cylinder 16. The thin portion 33 is made of rubber while the thick portion 34 is made of plastics. In this case, since the end face 39 of the thick portion 34 made of plastics is engaged with the front holder cylinder 22 which pushes towards the pen upon screwing in the coupling cylinder 21, the frictional resistance of the overlapped surfaces 37 will be overcome even if the thin portion 33 of rubber follows the rotation of the rotation-type shifting cylinder 16.

Figure 17:
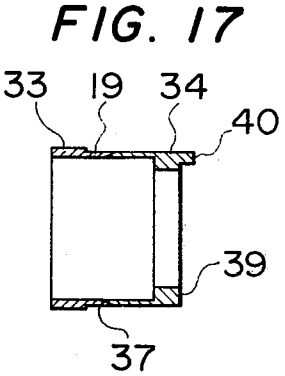
FIG. 17 is a longitudinal cross-sectional view of a fourth modification of the packing.
Figure 19:
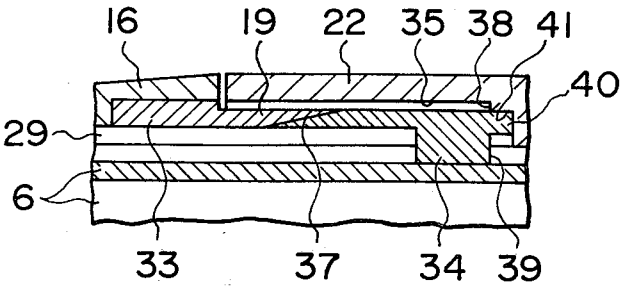
FIG. 19 is an enlarged cross-sectional view showing in FIG. 17.
Figure 18:
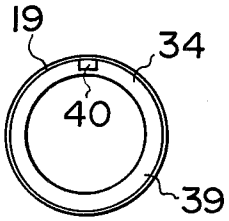
FIG. 18 is a right side view of the packing of FIG. 17.

Modifications of the packing in which the middle portion is divided into two overlapping parts will now be described. The packing shown in FIGS. 17 through 19 differs from the above-described example in that a small protrusion extending outwardly is provided on the end face 39 of the thick portion 34 and engaging with a small groove 41 which is formed in the step surface 38. In this case, the thick portion 34 is more positively engaged with the front holder cylinder 22 and therefore the frictional resistance with the thin portion 33 can be more positively overcome. As a result, rotation of the pen core cover can be positively prevented.

Figure 20:
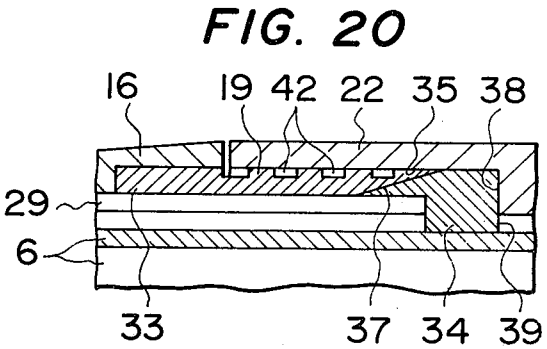
FIG. 20 is an enlarged cross-sectional view showing a part of a fountain pen provided with a fifth modification of the packing.

The modification shown in FIG. 20 differs in that comb-shaped grooves 42 are formed in the outer surface of the thin portion 33 which is in contact with the inner wall of the front holder cylinder 22 in such a manner that the grooves face the front holder cylinder 22. The comb-shaped grooves 42 are formed with a width and depth which will prevent capillary action. In this modification, even if ink should enter between the overlapped surfaces 37, the flow of ink will be stopped by the comb-shaped grooves 42 because of the absence of capillary action and accordingly leakage of ink from between the rotation-type shifting cylinder 16 and the front holder cylinder 22 is prevented.

Figure 21:
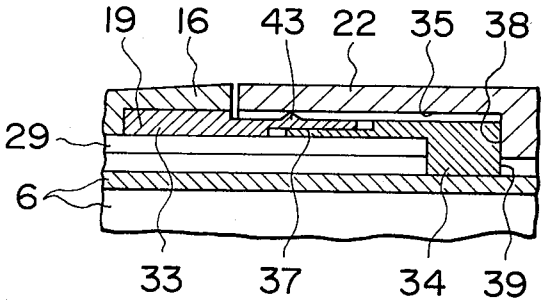
FIG. 21 is an enlarged cross-sectional view showing a part of a fountain pen provided with a sixth modification of the packing.

The modification shown in FIG. 21 is different from that of FIG. 20 in that the packing 19 is cut at the middle portion in a different manner and a protruding strip 43 is providing on the outer surface of one end portion of the thin portion 34 which extends towards the front holder cylinder 22 in such a manner that it is in contact with the front holder cylinder 22. In this modification, the leakage of ink is prevented similar to the above-described examples.

Figure 22:
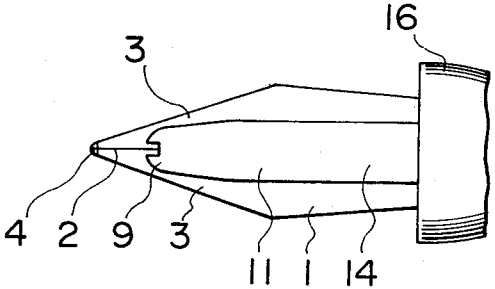
FIG. 22 is a plan view of one end portion of a fountain pen showing one modification of a retaining metal member employed in the invention.

The above-described retaining metal member 11 may be so modified that, as shown in FIG. 22, the end portion thereof is bifurcated. In this modification, the retaining metal member 11 is never in contact with the ink in the slit 2. Therefore, flow of ink to the upper surface of the pen tip 1 can be completely prevented.

Other embodiments of the invention will next be described.

Figure 23:
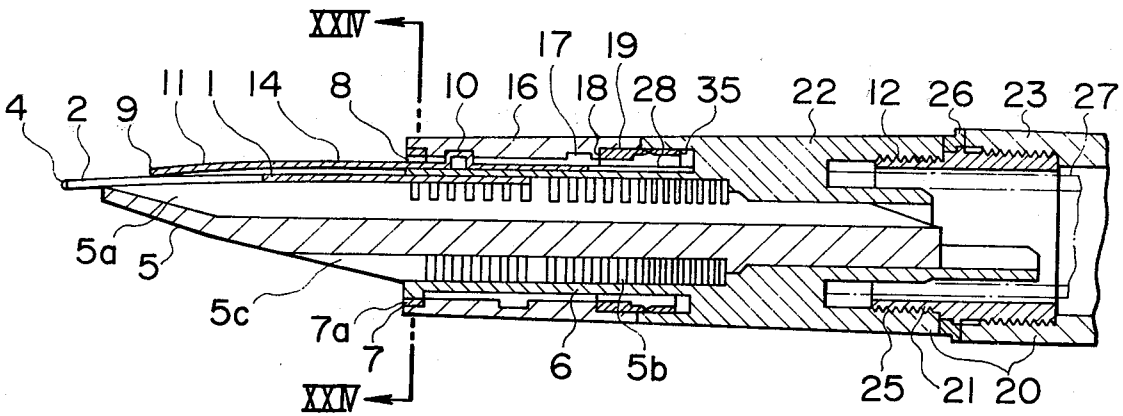
FIG. 23 is a longitudinal cross-sectional view showing one example of a fountain pen according to the invention.
Figure 24:
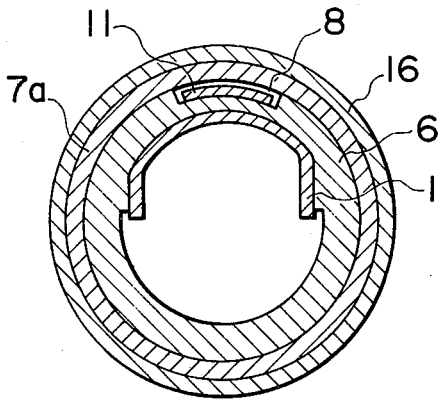
FIG. 24 is an enlarged cross-sectional view taken along line XXIV—XXIV in FIG. 23 except that the pen core is not shown.
Figure 25:
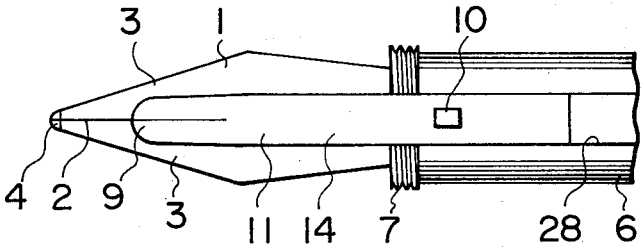
FIG. 25 is a plan view of the fountain pen shown in FIG. 23 from which a rotation-type shifting cylinder and a nut forming a guide have been removed.

In the embodiment shown in FIGS. 23 through 25, the rear portion of a pen core cover 6 into which the pen core 5 is inserted serves as the front holder cylinder 22 and the pen core cover 6 is provided with a guide 7 at its end portion closer to the pen tip or more specifically, the writing point. In the guide 7, a tunnel-shaped guide slot 8 is formed by a protrusion and a nut 7*a* screwed over the outer surface of the protrusion in such a manner that the guide slot 8 is on the axial line of the upper surface of the pen tip 1. A groove 28 is formed on the prolongation of the guide slot 8 to guide a flexible retaining metal member 11. In FIGS. 23 through 25, reference character 5*a* designates a capillary pen core groove, 5*b* a comb-shaped overflow ink containing chamber, and 5*c* an air groove.

In the abutment portions of the holder cylinder of the pen core cover 6 and of the rotation-type shifting cylinder 16, annular recesses 35 and 18 are provided, respectively. Adjacent the annular recesses 35 and 18 a cylindrical ink leakage preventing packing 19 is fixed which is in contact with both of the rotation-type shifting cylinder 16 and the holder cylinder 22 but is not in contact with the pen core cover.

Coupled to the holder cylinder 22 of the pen core cover 6 through a coupling cylinder is the rear holder cylinder 23 which together with the holder cylinder 20 forms the aforementioned holder cylinder 22.

Figure 26:
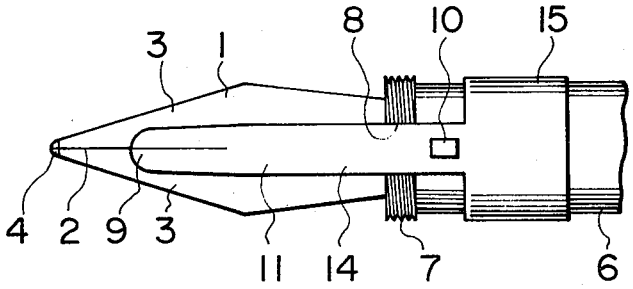
FIG. 26 is a plan view showing a modification of the connection between the pen core cover and the retaining metal member.
Figure 27:
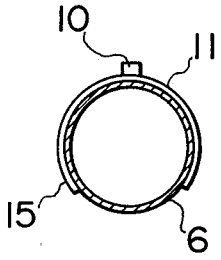
FIG. 27 is an explanatory view of a part of the fountain pen as viewed from right in FIG. 26.

The retaining metal member 11 employed in this embodiment may be so modified that, as shown in FIGS. 26 and 27, an annular portion 15 is provided at its end opposite to the end portion 9 so that it is slidably coupled to the pen core cover 6.

Figure 28:
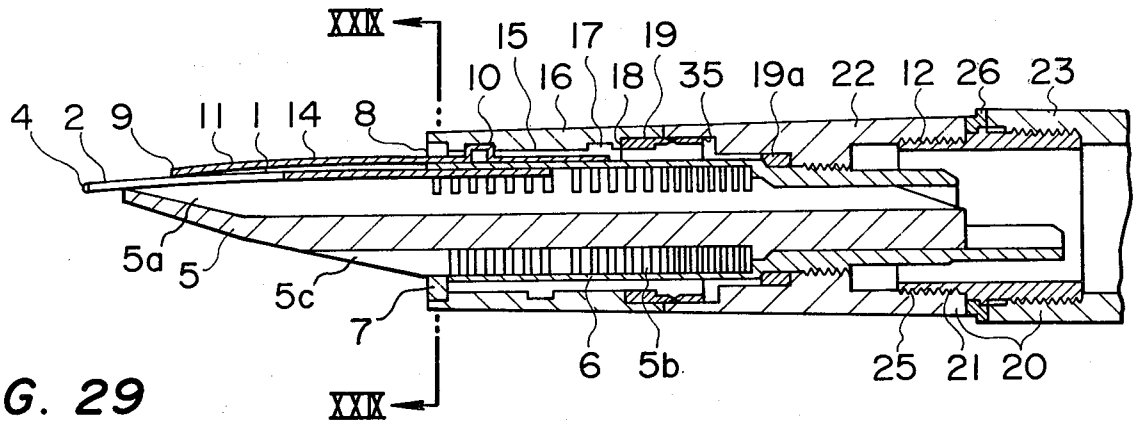
FIG. 28 is a longitudinal cross-sectional view showing another example of a fountain pen according to the invention.
Figure 29:
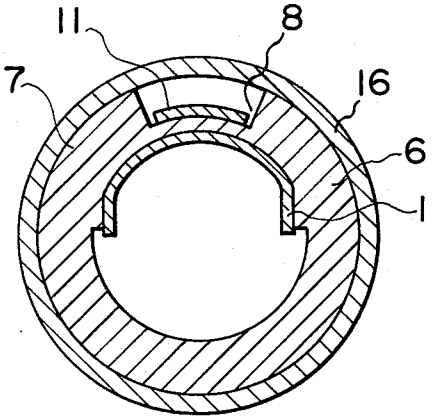
FIG. 29 is an enlarged cross-sectional view taken along line XXIX—XXIX in FIG. 28 except that a pen core is not shown.

In the embodiment shown in FIGS. 28 and 29, the pen core cover 6 is coupled to the front holder cylinder 22 by screwing the holder cylinder 22 over the core cover 6. Annular recesses are formed in the confronting surfaces of the pen core cover 6 and the front holder cylinder 22. A cylindrical ink leakage blocking packing 19*a* which is in contact with both of the pen core cover 6 and the front holder cylinder 22 is attached by these annular recesses. The guide 7 is made up of a flange with a groove-shaped guide slot 8. The other arrangement is similar to that in the above-described embodiments.

Figure 30:
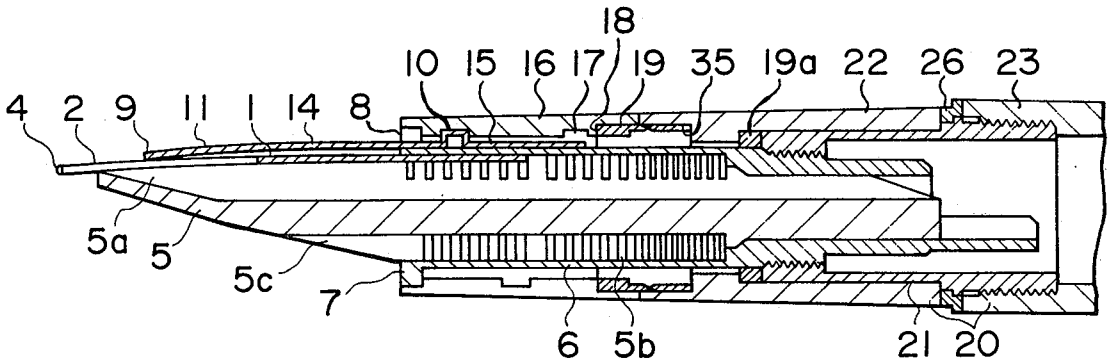
FIG. 30 and FIG. 31 are longitudinal cross-sectional views showing two other examples of fountain pens of the invention.
Figure 31:
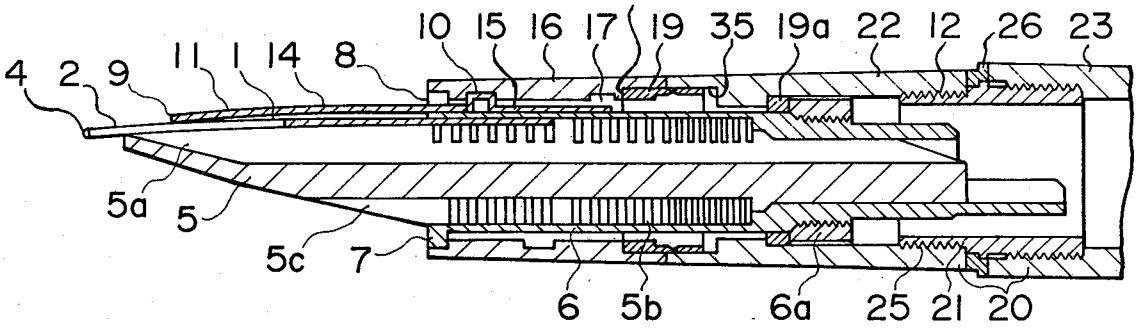

An ink blocking packing 19*a* used in this embodiment may be attached as follows. As shown in FIG. 30, the pen core cover 6 is screwed into the coupling cylinder 21 while the packing 19*a* is placed on the pen core cover 6, disposed in the recess of the front holder cylinder, and then tightened between the pen core cover 6 and the cylinder 21. Following this, as shown in FIG. 31, a threaded retainer 6*a* such as a nut is screwed on the pen core cover 6 so that the ink leakage preventing packing 19 is tightened between the retainer and the pen core cover 6. In this case, by adjusting the position of the threaded retainer 6*a*, tightening or releasing the rotation-type shifting cylinder 16 between the guide 7 of the pen core cover 6 and the front holder cylinder 16 can be effected as desired to control the rotation of the rotation-type shifting cylinder 16.

Figure 32:
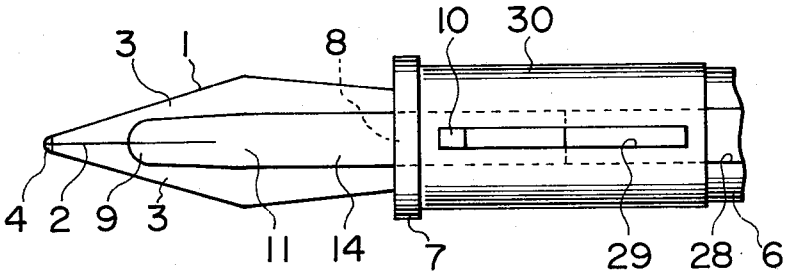
FIG. 32 is a plan view showing another modification of the connections of the pen core cover and the retaining metal member.

In the embodiment shown in FIG. 32, a knob 10 is engaged with the slot 29 of a cylindrical member 30 which forms a guide 7 in the retaining metal member 11 which is slidably engaged with the groove 28 provided on the extension of the tunnel-shaped guide slot 8 of the guide 7 of the pen core cover 6. The cylindrical member 30 is coupled to the pen core cover 6 by sliding it over the core cover 6.

Figure 33:
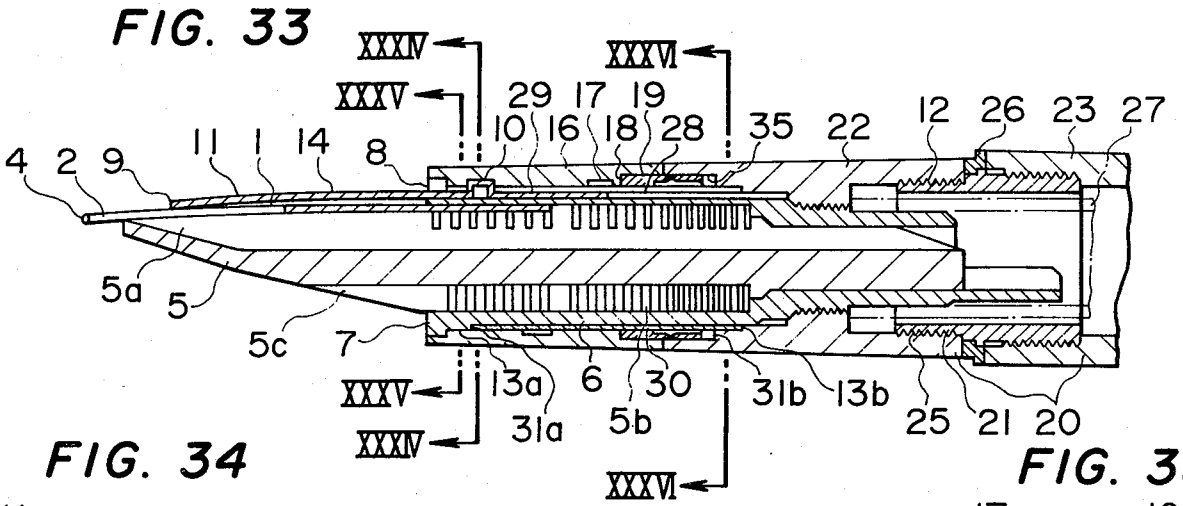
FIG. 33 is a longitudinal cross-sectional view showing another example of a fountain pen according to the invention.
Figure 35:
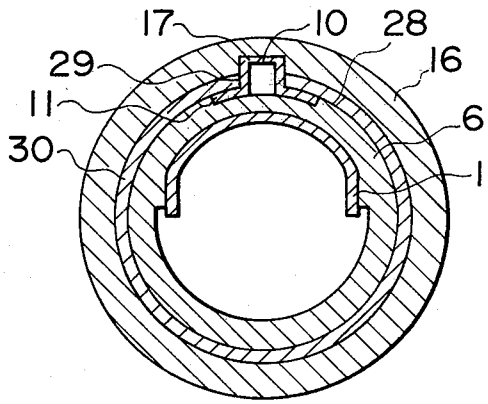
FIG. 34 through FIG. 36 are enlarged cross-sectional views taken along lines XXXIV—XXXIV, XXXV—XXXV and XXXVI—XXXVI in FIG. 33 respectively, except that the pen cores are not shown.
Figure 34:
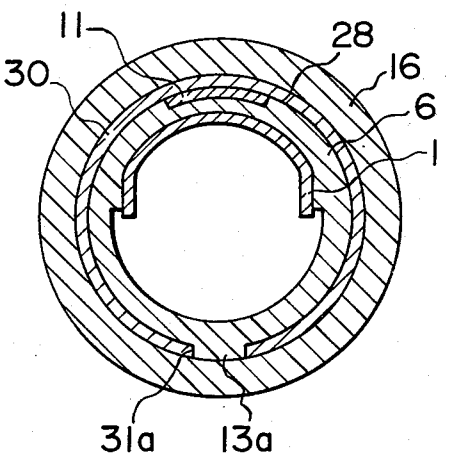

In the embodiment shown in FIGS. 33 through 36, a cylindrical member 30 is placed around the retaining metal member 11 and the two member 30 and 31 are coupled to the pen core cover 6. The cylindrical member 30 has a cut-out pen core cover coupling portion 31*a* at its end portion closer to the pen tip and a cut-out holder cylinder coupling portion 31*b*. The pen core cover coupling portion 31*a* is coupled to a protruding coupling portion 13*a* which is formed on the side of the end portion of the pen core cover 6 as seen in FIGS. 33 and 34 while the holder cylinder coupling portion 31*b* is coupled to a protruding coupling portion 13*b* which is formed on the inner wall of the front holder cylinder 22. The knob 10 is slidably engaged with a slot 29 formed in the cylindrical member 30.

The knob 10 is also engaged with a shifting groove 17 which is formed in the inner wall of the rotation-type shifting cylinder 16 and the rotation-type shifting cylinder 16 is rotatably mounted on the pen core cover with its end portion closer to the pen tip engaged with the guide 7.

Figure 37:
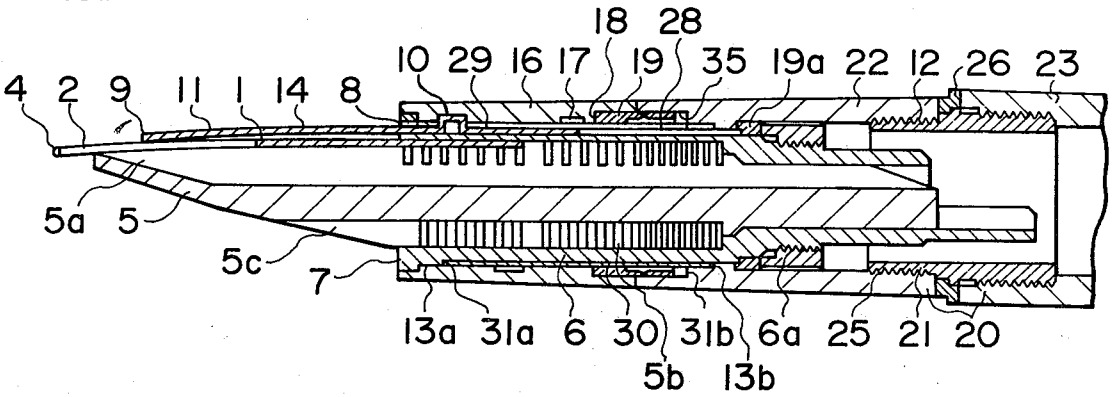
FIG. 37 is a longitudinal cross-sectional view showing another example of the fountain pen according to the invention.
Figure 36:
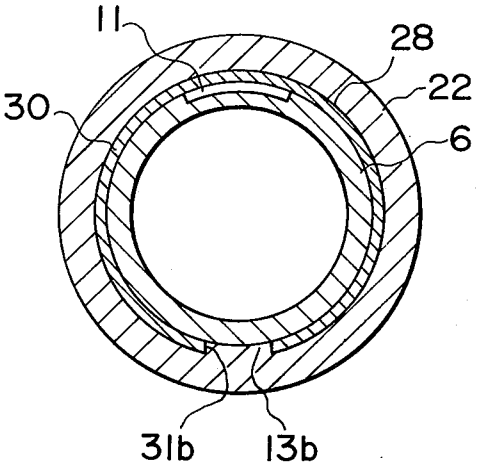

Shown in FIG. 37 is an embodiment of the invention similar to the embodiment of FIGS. 33 through 36 described immediately above in which a cylindrical ink blocking packing 19*a* is provided.

Figure 38:
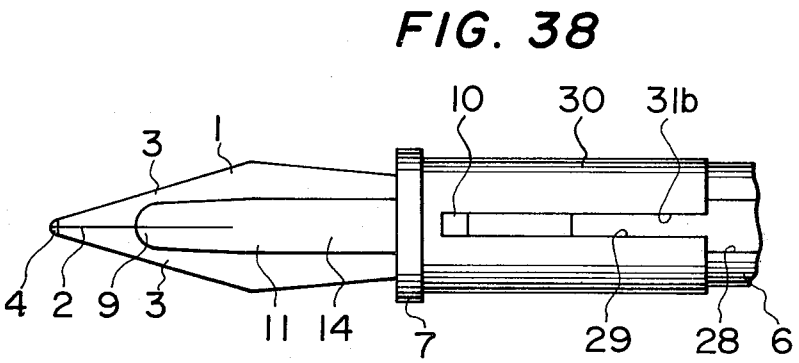
FIG. 38 is a plan view showing another example of the fountain pen from which a rotation-type shifting cylinder has been removed.
Figure 39:
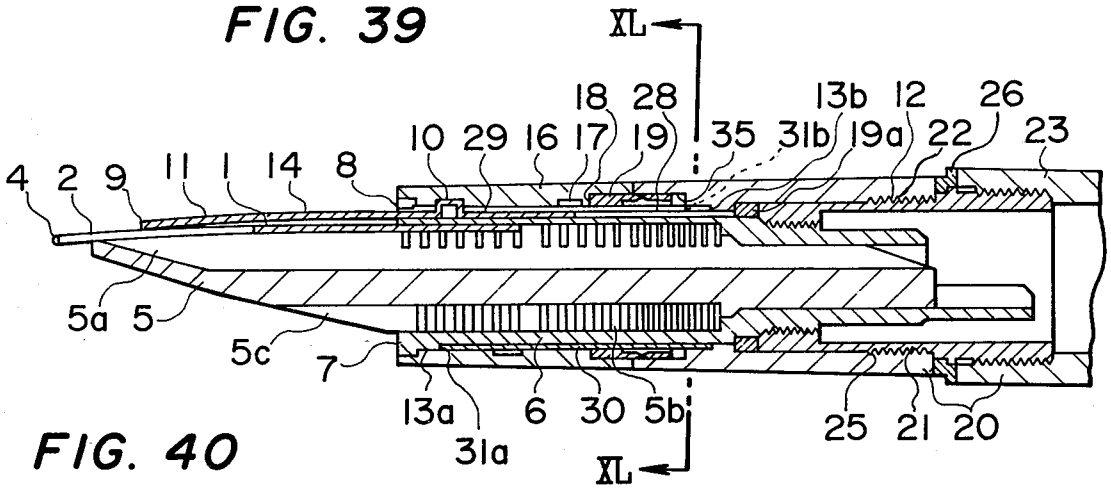
FIG. 39 is a longitudinal cross-sectional view showing the complete assembly of the fountain pen in FIG. 38.
Figure 40:
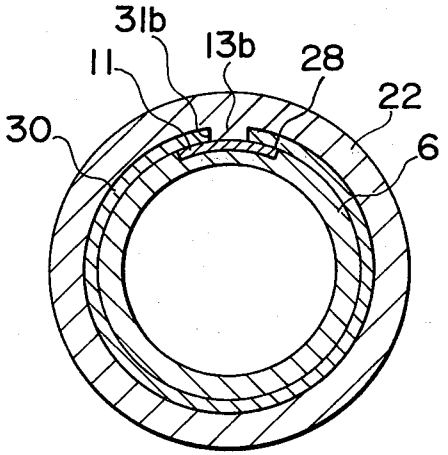
FIG. 40 is an enlarged cross-sectional view taken along line XL—XL in FIG. 39 with the pen core not shown.

Modifications of the coupling portions will next be described. In the modification shown in FIGS. 38 through 40, a cylindrical member 30 having a slot 29 which is opened at one end only is employed with the open end portion used as the holder cylinder coupling portion 31*b*. The holder cylinder coupling portion 31*b* is coupled to a protruding coupling portion 13*b* which is formed on the inner wall of the front holder cylinder.

Figure 41:
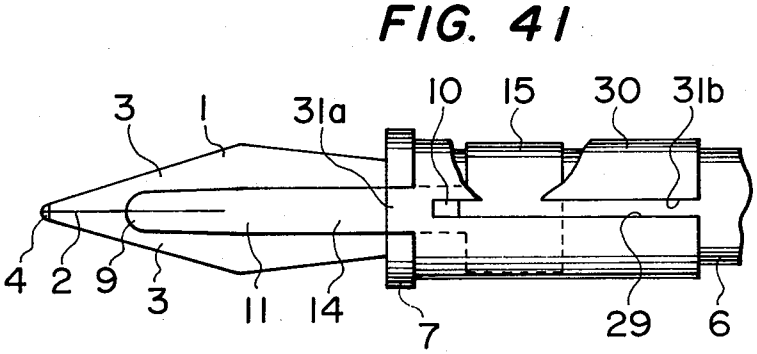
FIG. 41 is a plan view showing another example of a fountain pen of the invention from which a rotation-type shifting cylinder has been removed.
Figure 43:
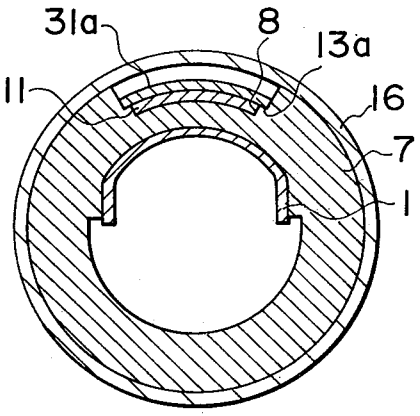
FIG. 43 is an enlarged cross-sectional view taken along line XLIII—XLIII in FIG. 42 with the pen core not shown.
Figure 42:
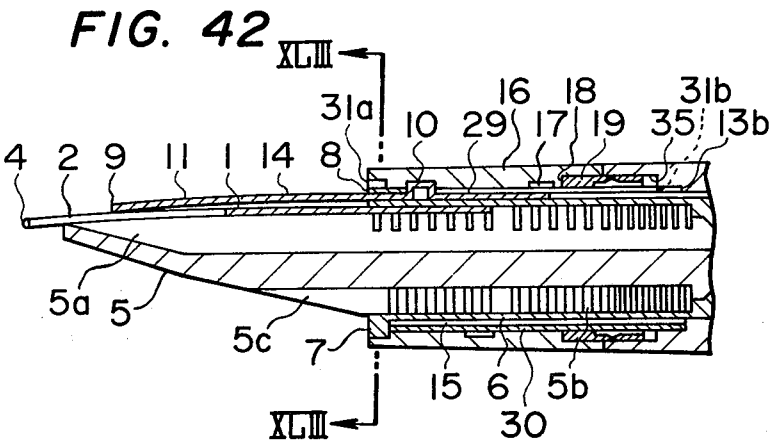
FIG. 42 is a longitudinal cross-sectional view showing the complete assembly of the fountain pen in FIG. 41.

In the modification shown in FIGS. 41 through 43, a protruding pen core cover coupling portion 31*a* protrudes towards the end closer to the pen tip of the cylindrical member 30. The coupling portion 31*a* is coupled to the pen core cover 6 through a step-like coupling portion 13*a* which is formed in the groove-shaped guide hole 8 of the guide 7. The end portion opposite to the end portion 9 of the retaining metal member 11 is formed as an annular portion 15 which is slidably coupled to the pen core cover 6.

Figure 44:
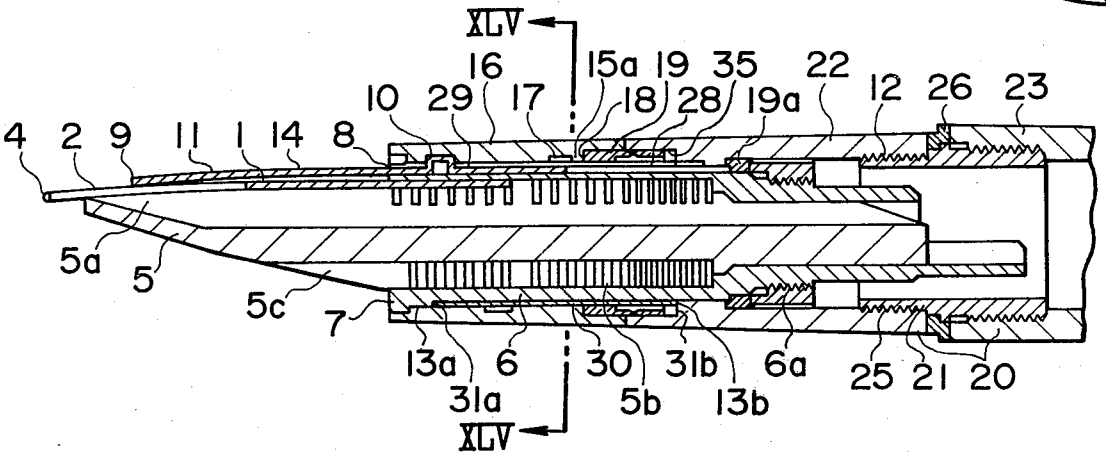
FIG. 44 is a longitudinal cross-sectional view showing another example of a fountain pen of the invention.
Figure 45:
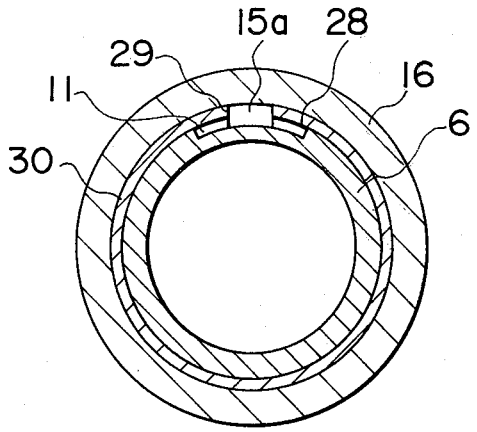
FIG. 45 is an enlarged cross-sectional view taken along line XLV—XLV in FIG. 44 with the pen core not shown.
Figure 46:
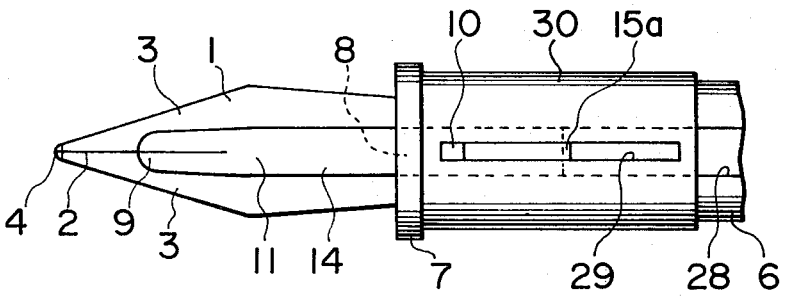
FIG. 46 is a plan view showing the fountain pen in FIG. 44 from which a rotation-type shifting cylinder has been removed.

In the modification shown in FIGS. 44 through 46, a protrusion 15*a* extending upwardly is formed on the end portion opposite to the end portion 9 of the retaining metal member 11. The protrusion 15*a* is slidably engaged with the slot 29 which is formed in the cylindrical member 30. In this case, the protrusion 15*a* is formed by bending the protrusion which extends from the end of the retaining metal member 11.

Figure 47:
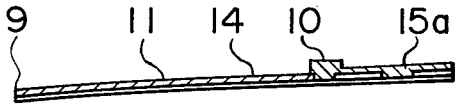
FIG. 47 is a longitudinal cross-sectional view of one modification of the retaining metal member employed with a pen of the invention.
Figure 48:
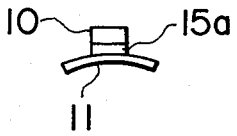
FIG. 48 is a right side view of the retaining metal member in FIG. 47.
Figure 49:
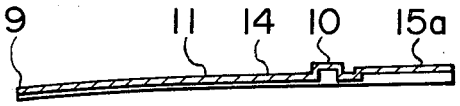
FIG. 49 is a longitudinal cross-sectional view of another modification of the retaining metal member.
Figure 50:
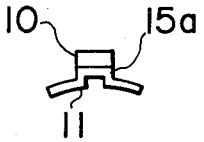
FIG. 50 is a right side view of the retaining metal member in FIG. 49.
Figure 51:
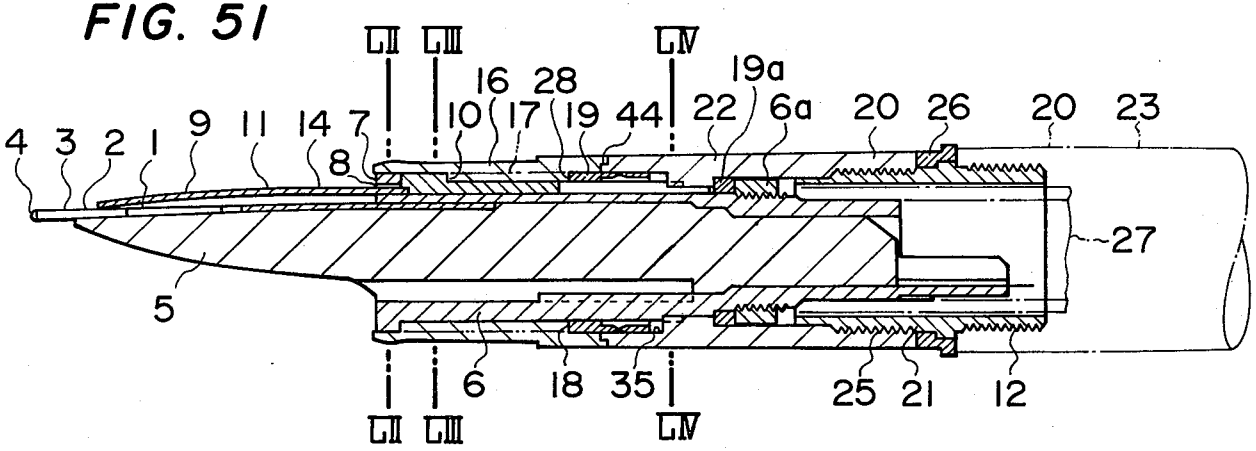
FIG. 51 is a longitudinal cross-sectional view showing a part of another example of the fountain pen according to the invention.

Such a protrusion 15*a* may be formed by securing a small piece to the retaining metal member as shown in FIGS. 47 and 48 or by expanding a part of the retaining metal member 11 as shown in FIGS. 49 and 50.

Figure 52:
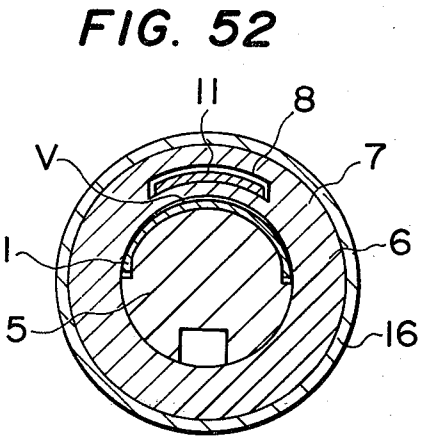
FIG. 52 is an enlarged cross-sectional view taken along line LII—LII in FIG. 51.

Another embodiment of the invention will be described with reference to FIGS. 51 through 54. A plastic pen core cover 6 into which a pen core 5 is inserted has a flange-shaped guide 7 at its end portion closer to the pen. A tunnel-shaped guide hole 8 is formed in the guide 7 in such a manner that it is on the axial line of the upper surface of the pen tip 1. A groove 28 is provided on the extension of the guide hole 8 to guide the flexible retaining metal member 11 and an air gap V is formed between the upper surface of the mounting portion of the pen tip and the pen core cover 6 as seen in FIG. 52.

Figure 54:
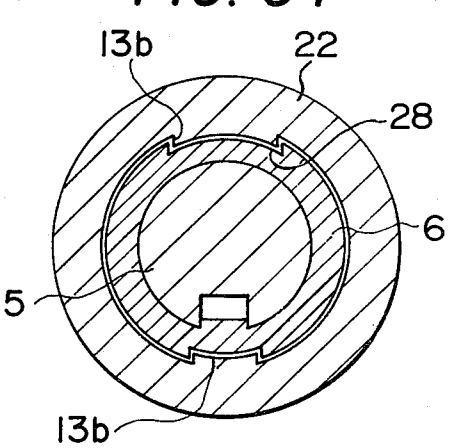
FIG. 54 is an enlarged cross-sectional view taken along the LIV—LIV in FIG. 51.
Figure 53:
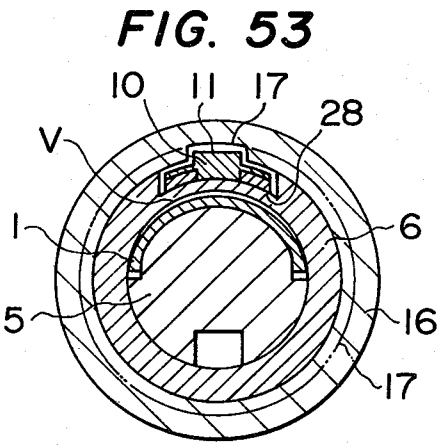
FIG. 53 is an enlarged cross-sectional view taken along line LIII—LIII in FIG. 51.

A holder cylinder 22 which is placed over the pen core cover 2 together with the rotation shifting cylinder 16 has two opposed, protruding coupling portions 13*b* on the inner wall of its end portion closer to the pen. One of the protruding coupling portions 13*b* engages the groove 28 which is formed in the pen core cover 6 while the other portion engages a groove-shaped coupling portion which is formed in the pen core cover 6 as depicted in FIG. 54. A neck-shaped small diameter portion 44 is formed on the end face closer to the rotation-type shifting cylinder 16 of the holder cylinder 22 and the small diameter portion 44 is inserted into the rotation-type shifting cylinder 16. Annular recesses 18 and 35 are formed in the abutment portions of the holder cylinder 22 and the rotation-type shifting cylinder 16 respectively. A cylindrical ink leakage preventing packing 19 which is in contact with the inner surfaces of the rotation-type shifting cylinder and the holder cylinder 22 is attached by the recesses 18 and 35. In addition, a cylindrical ink blocking packing 19*a* is disposed between the pen core cover 6 and the holder cylinder 22 and is held in place by a threaded stopper which is screwed over the pen core cover 6.

Similar to the embodiment of FIG. 46, the knob or protrusion 10 can be provided by a separate slider member which has a protrusion on its lower surface which mates with an aperture in the retaining member 11 and a second protrusion on its upper surface which functions as knob 10.

As is apparent from the above-description, the present invention satisfies all of the requirements specified above for a fountain pen provided in which the resiliency of the pen tip can be controlled steplessly. Furthermore, the construction of a pen of the invention is simple so that it can be assembled and operated with ease.

What is claimed is:

1. A fountain pen comprising:

a pen core;

a pen tip having a writing point, said pen tip being operatively mounted on said pen core;

a pen tip mounting portion and an overflow ink containing chamber formed in said pen core;

a pen core cover positioned around a portion of said pen core and sealingly covering at least said pen tip mounting portion and said over-flow ink containing chamber formed in said pen core, said core cover including a guide portion having a guide slot formed at least on a surface of one end portion of said guide portion closer to said writing point in such a manner that said guide slot lies along an axial line of the upper surface of said pen;

a tongue-shaped flexible retaining member having a first end portion contacting said pen tip, a curved portion which is curved towards said point, an air gap formed between said curved portion and said tip, and a straight portion which is not in contact with said tip, said retaining member being positioned in said guide slot so as to be slidable on the outer surface of said pen core cover and to be slidable with respect to said pen tip;

knob means coupled to an outer surface of said retaining member;

a rotation-type shifting cylinder rotatably mounted around said pen core cover, said shifting cylinder having a spiral groove formed on an inner surface thereof, said knob means being engaged with said groove on said inner surface; and a holder cylinder to which is detachably mounted said pen core cover.

2. A fountain pen comprising:

a pen core;

a pen tip having a writing point, said pen tip being operatively mounted on said pen core;

a pen tip mounting portion and an overflow ink containing chamber formed in said pen core;

a pen core cover position around a portion of said pen core sealingly covering at least a pen tip mounting portion and an over-flow ink containing chamber formed in said pen core, said core cover including a guide portion having a guide slot formed at least on a surface of one end portion of said guide portion closer to said writing point in such a manner that said guide slot lies along an axial line of the upper surface of said pen;

a tongue-shaped flexible retaining member having a first end portion contacting said pen tip, a curved portion which is curved towards said point, an air gap formed between said curved portion and said tip, and a straight portion which is not in contact with said tip, said retaining member being positioned in said guide slot so as to be slidable on the outer surface of said pen core cover and to be slidable with respect to said pen tip;

knob means coupled to an outer surface of said retaining member;

a rotation-type shifting cylinder rotatably mounted around said pen core cover, said shifting cylinder having a spiral groove formed on an inner surface thereof, said knob means being engaged with said groove on said inner surface;

a holder cylinder to which is detachably mounted said pen core cover; and a cylindrical ink leakage preventing packing disposed in an air gap formed between said rotation-type shifting cylinder and said pen core cover in such a manner that said packing is in contact with both a portion of said inner surface of said rotation-type shifting cylinder and said pen core cover.

3. A fountain pen comprising:

a pen core;

a pen tip having a writing point, said pen tip being operatively mounted on said pen core;

a pen tip mounting portion and an overflow ink containing chamber formed in said pen core;

a pen core cover positioned around a portion of said pen core sealingly covering at least a pen tip mounting portion and an over-flow ink containing chamber formed in said pen core, said core cover including a guide portion having a guide slot formed at least on a surface of one end portion of said guide portion closer to said writing point in such a manner that said guide slot lies along an axial line of the upper surface of said pen;

a tongue-shaped flexible retaining member having a first end portion contacting said pen tip, a curved portion which is curved towards said point, an air gap formed between said curved portion and said tip, and a straight portion which is not in contact with said tip, said retaining member being positioned in said guide slot so as to be slidable on the outer surface of said pen core cover and to be slidable with respect to said pen tip;

knob means coupled to an outer surface of said retaining member;

a rotation-type shifting cylinder rotatably mounted around said pen core cover, said shifting cylinder having a spiral groove formed on an inner surface thereof, said knob means being engaged with said groove on said inner surface;

a holder cylinder to which is detachably mounted said pen core cover;

a cylindrical ink leakage preventing packing disposed in an air gap formed between said rotation-type shifting cylinder and said pen core cover in such a manner that said packing is in contact with both a portion of said inner surface of said rotation-type shifting cylinder and said pen core cover; and a cylindrical ink blocking packing disposed in an air gap formed between said pen core cover and said holder cylinder in such a manner as to be in contact with both said pen core cover and said holder cylinder.

4. A fountain pen as claimed in any of claims 1, 2 or 3 in which said guide portion comprises a protrusion having a groove-shaped guide slot.

5. A fountain pen as claimed in claim 4 in which said protrusion comprises a flange.

6. A fountain pen as claimed in any of claim 1, 2 or 3 in which said guide portion comprises a protrusion having a tunnel-shaped guide hole.

7. A fountain pen as claimed in claim 6 in which said protrusion comprises a flange.

8. A fountain pen as claimed in ay of claims 1, 2 or 3 in which said guide portion comprises a protrusion having a groove-shaped guide slot and a nut screwed over said protrusion, a portion of an inner surface of said nut forming, together with said guide slot, a tunnel-shaped guide hole.

9. A fountain pen as claimed in any of claims 1, 2 or 3 in which said guide portion comprises a guide hole and a slot forming an extension of said guide hole.

10. A fountain pen as claimed in any of claims 1, 2 or 3 in which said guide comprises a guide hole, a cylindrical member having a slot engaged with said knob, the longitudinal direction of said slot being coincident with an extension of said guide hole.

11. A fountain pen as claimed in any of claims 1, 2 or 3 in which a second end portion opposite said first end portion of said retaining member comprises an annular portion slidably mounted on said pen core cover so as to couple said retaining member to said pen core cover.

12. A fountain pen as claimed in any of claims 1, 2 or 3 in which said pen core cover is coupled directly to said holder cylinder.

13. A fountain pen as claimed in any of claims 1, 2 or 3 further comprising a coupling cylinder, said pen core cover being coupled to said holder cylinder through said coupling cylinder.

14. A fountain pen as claimed in any of claims 1 to 3 in which said knob means comprises a portion of said retaining member formed as a knob.

15. A fountain pen as claimed in any of claims 1 to 3 in which said knob means comprises a slider member formed separate from said retaining member, an aperture in said retaining member, said slider means having a first protrusion on one side thereof mating with said aperture in said retaining member and a second protrusion on an opposite side.

16. A fountain pen as claimed in either of claims 2 or 3 in which said cylindrical ink leakage preventing packing is positioned in contact with said rotation-type shifting cylinder, said holder cylinder and said pen core cover.

17. A fountain pen as claimed in claim 16 in which said cylindrical ink leakage preventing packing comprises a ring-shaped packing positioned between said rotation-type shifting cylinder and said holder cylinder.

18. A fountain pen as claimed in claim 16 in which said cylindrical ink leakage preventing packing comprises a packing positioned between said rotation-type shifting cylinder and said holder cylinder, said packing comprising an end portion extending into said holder cylinder so as to be in contact with the inner surface of said holder cylinder.

19. A fountain pen as claimed in claim 16 in which said cylindrical ink leakage preventing packing comprises a packing held by said rotation-type shifting cylinder, said holder cylinder and said pen core cover, said packing comprising an end portion extending into said holder cylinder so as to be in contact with the inner surface of said holder cylinder, and said packing comprising two overlapping parts.

20. A fountain pen as claimed in claim 3 in which said pen core cover is screwed into said holder cylinder, so that said cylindrical ink blocking packing is tightened and fixed between said pen core cover and said holder cylinder.

21. A fountain pen as claimed in claim 3 in which said pen core cover is screwed into a coupling cylinder, said cylindrical ink blocking packing is positioned and tightened between said pen core cover and said coupling cylinder.

22. A fountain pen as claimed in claim 3 further comprising a threaded stopper screwed over said pen core cover, said cylindrical ink blocking packing being positioned and tightened between said threaded stopper and said pen core cover.

* * * * *